US005919035A

United States Patent [19]

Iwama et al.

[11] Patent Number: 5,919,035

[45] Date of Patent: Jul. 6, 1999

[54] CROSS FLOW TYPE BURNER APPARATUS

[75] Inventors: Yuji Iwama; Akira Kanda, both of Nagoya, Japan

[73] Assignee: Rinnai Kabushiki Kaisha, Nagoya, Japan

[21] Appl. No.: 08/825,698

[22] Filed: Mar. 19, 1997

[30] Foreign Application Priority Data

Mar. 19, 1996 [JP] Japan ..... 8-062520
Feb. 14, 1997 [JP] Japan ..... 9-030920

[51] Int. Cl.[6] ..... F23N 5/24

[52] U.S. Cl. ..... 431/22; 431/76; 431/78; 431/90; 126/116 R

[58] Field of Search ..... 126/116 R; 431/285, 431/326, 328, 349, 75.76, 2.8, 22, 186, 33, 350.78

[56] References Cited

U.S. PATENT DOCUMENTS

| | | | |
|---|---|---|---|
| 3,295,585 | 1/1967 | Kovich, Jr. et al. | 431/22 |
| 3,610,792 | 10/1971 | Risse | 431/22 |
| 3,918,880 | 11/1975 | Risse | 431/22 |
| 4,221,557 | 9/1980 | Jalics | 431/22 |
| 4,358,265 | 11/1982 | Tanaka | 431/76 |
| 4,396,369 | 8/1983 | Kaessmann | 431/76 |

FOREIGN PATENT DOCUMENTS

| | | |
|---|---|---|
| 0 562 538 | 9/1993 | European Pat. Off. . |
| 2 418 907 | 2/1979 | France . |

OTHER PUBLICATIONS

"American National Standard/National Standard of Canada for Gas–Fired Central Furnaces"; (ANSI Z21.47–1993, CAN/CGA–2.3–M93); May 26, 1993; American National Standards Institute, Inc. & Mar. 31, 1993; Standards Council of Canada; pp. 48–63.

*Primary Examiner*—James C. Yeung
*Attorney, Agent, or Firm*—Sughrue, Mion, Zinn, Macpeak & Seas, PLLC

[57] ABSTRACT

In a cross flow type burner apparatus, a burner is provided to which a gaseous fuel and air are supplied by a blower. An air reduction member is provided to reduce an amount of air supplied to specified flame holes of the burner wherein the reduced amount of air is less than the amount of air supplied to the other flame holes. A temperature sensor is provided to detect the burning condition of flames built up on the specified flame holes. A safety member is activated depending on an output generated from the temperature sensor.

15 Claims, 10 Drawing Sheets

CROSS FLOW TYPE BURNER APPARATUS

BACKGROUND OF THE INVENTION

1. Field of the Invention

The invention relates to a cross flow type burner apparatus equipped with a safety device to detect, with the use of a temperature sensor, whether or not a burning condition has deteriorated.

2. Description of Prior Art

In this type of the burner apparatus, a burner is provided to which air is forcibly supplied to build up flames thereon by means of a blower. A safety device is provided to detect when a burning condition has deteriorated in order to regulate a emission of noxious substances such as carbon monoxide and the like so that they are maintained under a predetermined level. In order to maintain a safety valve open, which safety valve is provided on a fuel supply passage, a flame rod is introduced as a temperature sensor to detect the presence of flames so as to determine the burning condition of the burner.

However, when a length of exhaust pipe is altered or a passage is clogged somewhere on way from an inlet to outlet by foreign matter such as a piece of snow, a cobweb, a bird's nest or the like, an amount of air supply to the burner decreases due to an increased air resistance so as to deteriorate the burning condition. The same is true when the blower accidentally decreases its amount of air supply.

OBJECTS OF THE INVENTION

With this in mind, it is possible to detect the burning condition at specified flame holes which deteriorate earlier than the other flame holes of the burner. By providing a temperature sensor at the specified flame holes, it is possible to activate a safety device before the burning condition of all the flame holes would deteriorate, thus effectively regulating the emission of noxious substance such as carbon monoxide and the like.

Therefore, it is a main object of the invention to provide an air-fed type burner apparatus which has specified flame holes in which the burning condition deteriorates earlier than that in the other flame holes of the burner so as to quickly activate the safety device when an amount of air supply is reduced before the burning condition of all the flame holes would deteriorate.

SUMMARY OF THE INVENTION

According to the present invention, there is provided an air-fed type burner apparatus comprising: a burner to which a gaseous fuel and air are supplied by means of a blower; an air-reduction member provided to reduce an amount of air supplied to specified flame holes of the burner to an amount less than the amount of air supplied to the other flame holes; a temperature sensor provided to detect a burning condition of flames built up on the specified flame holes; and a safety member activated depending on an output generated from the temperature sensor.

According to another aspect of the present invention, the air-reduction member is a secondary air reduction member which regulates an amount of secondary air supplied to the specified flame holes of the burner.

According to yet another aspect of the present invention, the burner comprises a support frame and a plurality of flat burner units on which the flame holes are provided. The flat burner units are interfit into the support frame to be longitudinally or latitudinal arranged with their neighboring spaces as secondary air passages.

According to another aspect of the present invention, the secondary air reduction member is a secondary air shield plate provided downstream of the flames built up on the specified flame holes.

According to another aspect of the present invention, the secondary air reduction member is a secondary air passage shield plate which clogs the space between the burner units or the space between the support frame and the burner units.

According to another aspect of the present invention, the secondary air shield plate comprises a horizontal portion directed along the flames built up on the specified flame holes, and a vertical portion directed to intersect the flames built up on the specified flame holes.

According to another aspect of the present invention, the temperature sensor is a flame rod or a thermocoupler.

With the above structure thus disclosed, lifts of flames on the specified flame holes are detected earlier than the other flame holes when the specified burning condition deteriorates. This makes it possible to activate the safety device before the burning condition of all the flame holes deteriorate due to the length of the exhaust pipe being altered, or due to the air supply and exhaust passage being clogged somewhere along the way from the inlet to outlet.

According to another aspect of the present invention, the safety member has a plurality of reference values for determining whether or not to activate in response to different outputs generated from the temperature sensor.

In general, a flame rod and thermocoupler have been used as a temperature sensor which are usually provided with a certain space interposed against the flames. When a single reference value determines whether to activate the safety devices, it does not matter if the burner always maintains a constant burning condition. When lengths of the flames change depending on type of the combustion fuel and combustion quantity, the outputs from the temperature sensor are generated differently even under the constant air ratio.

In the case of a single reference value provided to determine whether to activate the safety device, it is necessary to have the reference value correspond to the output generated from the temperature sensor when the burning condition would have deteriorated the worst.

However, even if a normal burning condition is maintained, the safety device may be activated to inadvertently cease the combustion of the burner when the temperature sensor generates an output corresponding to the reference value.

Because the safety member has a plurality of reference values to determine whether to be activated or not, the safety member is activated by the different reference values.

Consequently, it is possible to determine the optimal reference values depending on the burning condition, thus conveniently ensuring safety at various burning conditions so as to prevent the safety device from being activated inadvertently.

According to another aspect of the present invention, the plurality of reference values correspond to a plurality of combustion quantity values which change depending on burning condition of the burner. The safety member then determines whether to activate or not by selecting one mode among the reference value versus the combustion quantity value.

Generally, the burning condition changes depending on the combustion quantity. In this case, an optimal reference value can be determined in a wide range from smaller to greater combustion quantity by considering the different flame lengths in correspondence to the combustion quantities. This makes it possible to ensure safety at various burning conditions to prevent the safety device from being activated inadvertently.

According to another aspect of the present invention, the plurality of the reference values correspond to a plurality of combustion fuel types which change depending on burning condition of the burner, and the safety member determines whether to activate or not by selecting one mode among the reference value versus the combustion fuel type.

According to another aspect of the present invention, a plurality of combinations among the reference value versus the combustion quantity value are determined, and the safety member selects one mode among the combinations of the reference value versus the combustion quantity value depending on the burning condition of the burner.

According to another aspect of the present invention, a mode selection member is provided through which the safety member selects the one mode among the combinations of the reference value versus the combustion quantity value. The mode selection member is a manual switch to set a desired mode depending on the combustion fuel type to be used.

When different fuel types are used in the common burner to produce the same combustion quantity, the flame lengths differ depending on the fuel types used. With this in mind, an optimal reference value can be determined in correspondence to the different fuel types by considering the different flame lengths in correspondence to the fuel types. This makes it possible to ensure safety at various fuel types and to prevent the safety device from being activated inadvertently.

In the case in which the burner is operated under a constant combustion quantity, it is possible to maintain safety by changing the reference value itself depending on the different fuel types. When the burner is operated under the various combustion quantities, it is possible to determine the reference value in correspondence to the combustion quantity under the particular fuel type by selecting one mode among the combinations of the reference values and the combustion quantities depending on the fuel type used.

A manual switch, provided to change the reference values of the safety device depending the fuel types to be used, enables an operator to set an appropriate reference value in correspondence to the fuel type.

According to another aspect of the present invention, a plurality of the reference values correspond to a plurality of air supply and exhaust lengths of the burner. The safety member then determines whether to activate or not by selecting one mode among the reference value versus the air supply and exhaust length.

According to another aspect of the present invention, a plurality of combinations among the reference value versus the air supply and exhaust length are determined. The safety member then selects one mode of the combinations among the reference value versus the the air supply and exhaust length depending on the burning condition of the burner.

According to another aspect of the present invention, a mode selection member is provided through which the safety member selects one mode among the combinations of the reference value versus the combustion quantity value. The mode selection member is a connection determining switch mounted on an air supply and exhaust passage connection. The made selection member then automatically sets a desired combustion quantity depending on whether or not an air supply and exhaust passage extension member is connected to the air supply and exhaust passage connection. The air supply and exhaust passage extension may be detachably connected to the air supply and exhaust passage extension.

According to another aspect of the present invention, a mode selection member is provided through which the safety member selects one mode among the combinations of the reference value versus the combustion quantity value. The mode selection member is a connection switch mounted on an air supply and exhaust passage connection to manually set a desired combustion quantity depending on whether or not an air supply and exhaust passage extension member is connected to the air supply and exhaust passage connection. The air supply and exhaust passage extension may be detachably connected as required.

When the air supply and exhasut passage extension pipe is connected to a common burner to form the air supply and exhaust passage of different lengths, it produces flames of different lengths depending on the air supply and exhaust passage length even under a constant combustion quantity. With this in mind, it is possible to determine the optimal reference value in correspondence to the passages of different lengths by considering the different flame lengths in correspondence to the passages of different lengths. This makes it possible to ensure safety at various passage lengths to prevent the safety device from being activated inadvertently.

In the case in which the burner is operated under a constant combustion quantity, it is possible to to maintain safety by changing the reference value itself depending on the passage length. When the burner is operated under various combustion quantities, it is possible to determine the reference value in correspondence to the combustion quantity under the particular passage length by selecting one mode among the combinations of the reference values and the combustion quantities depending on the passage length to be used.

A manual switch, provided to change the reference values of the safety device depending the fuel type used, enables an operator to set an appropriate reference value in correspondence to the fuel type used.

DETAILED DESCRIPTION OF THE PREFERRED EMBODIMENTS OF THE INVENTION

Figure 1:
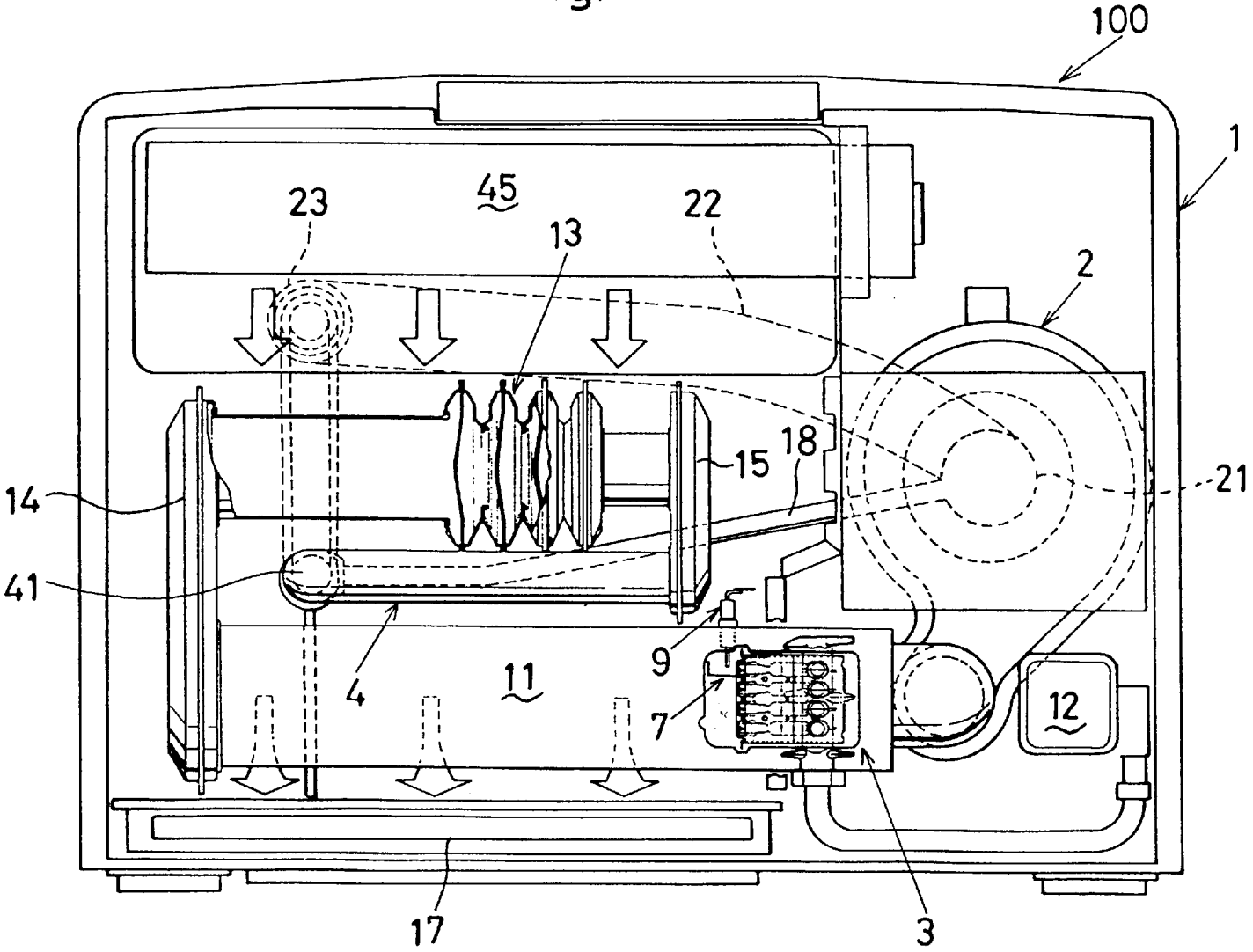
FIG. 1 is a front view of a gas heater apparatus according to a first embodiment of the invention.
Figure 2:
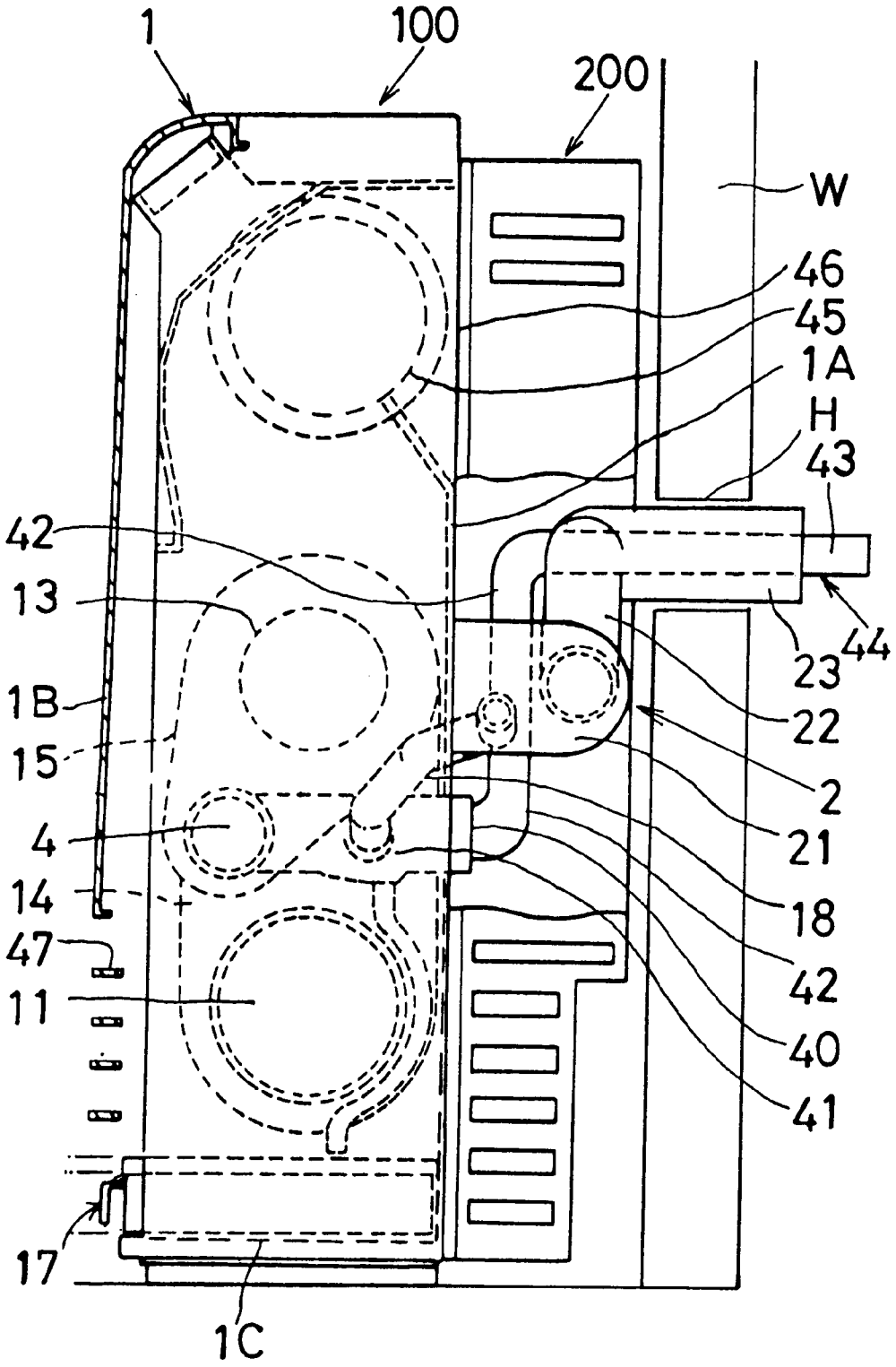
FIG. 2 is a side elevational view of the gas heater apparatus when installed along a building wall, but partially sectioned.
Figure 3:
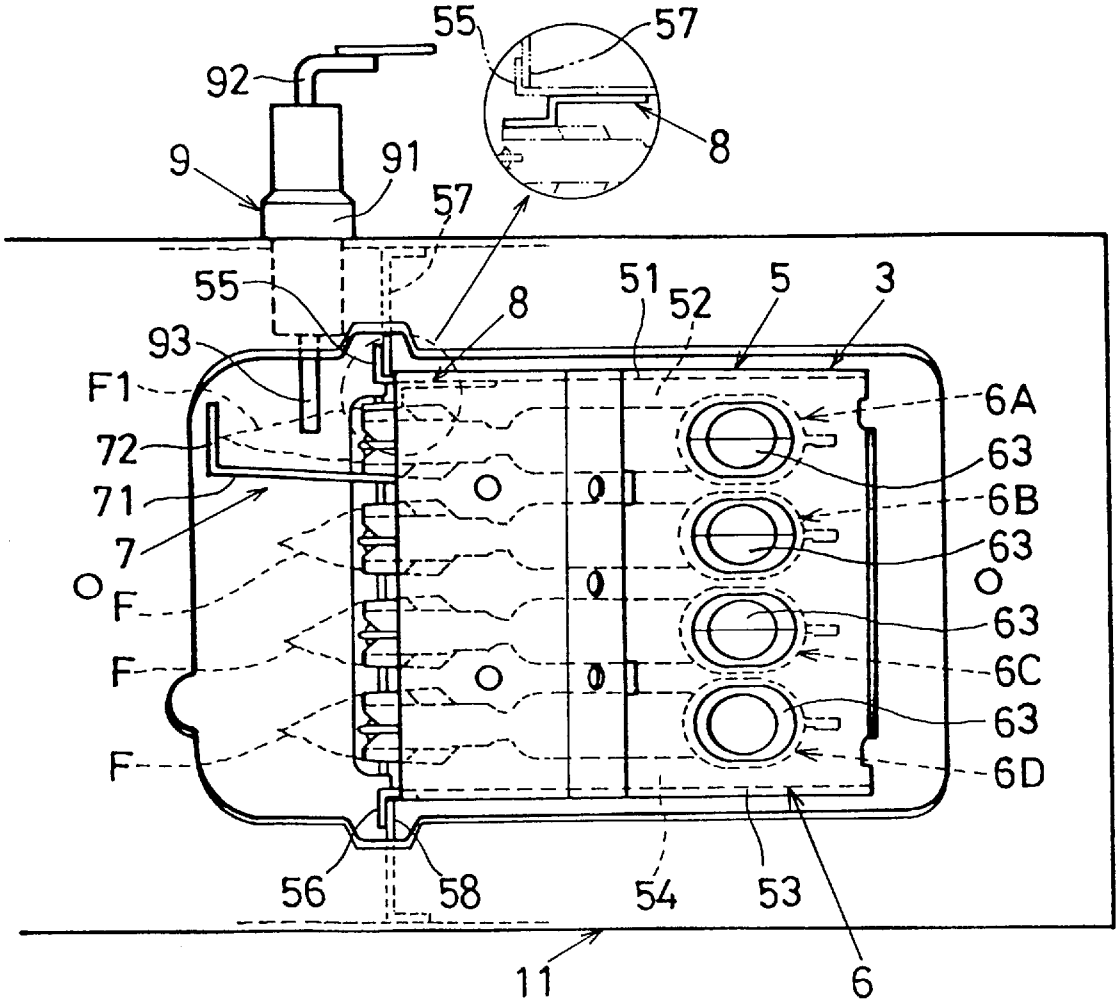
FIG. 3 is a front view of a burner.
Figure 4:
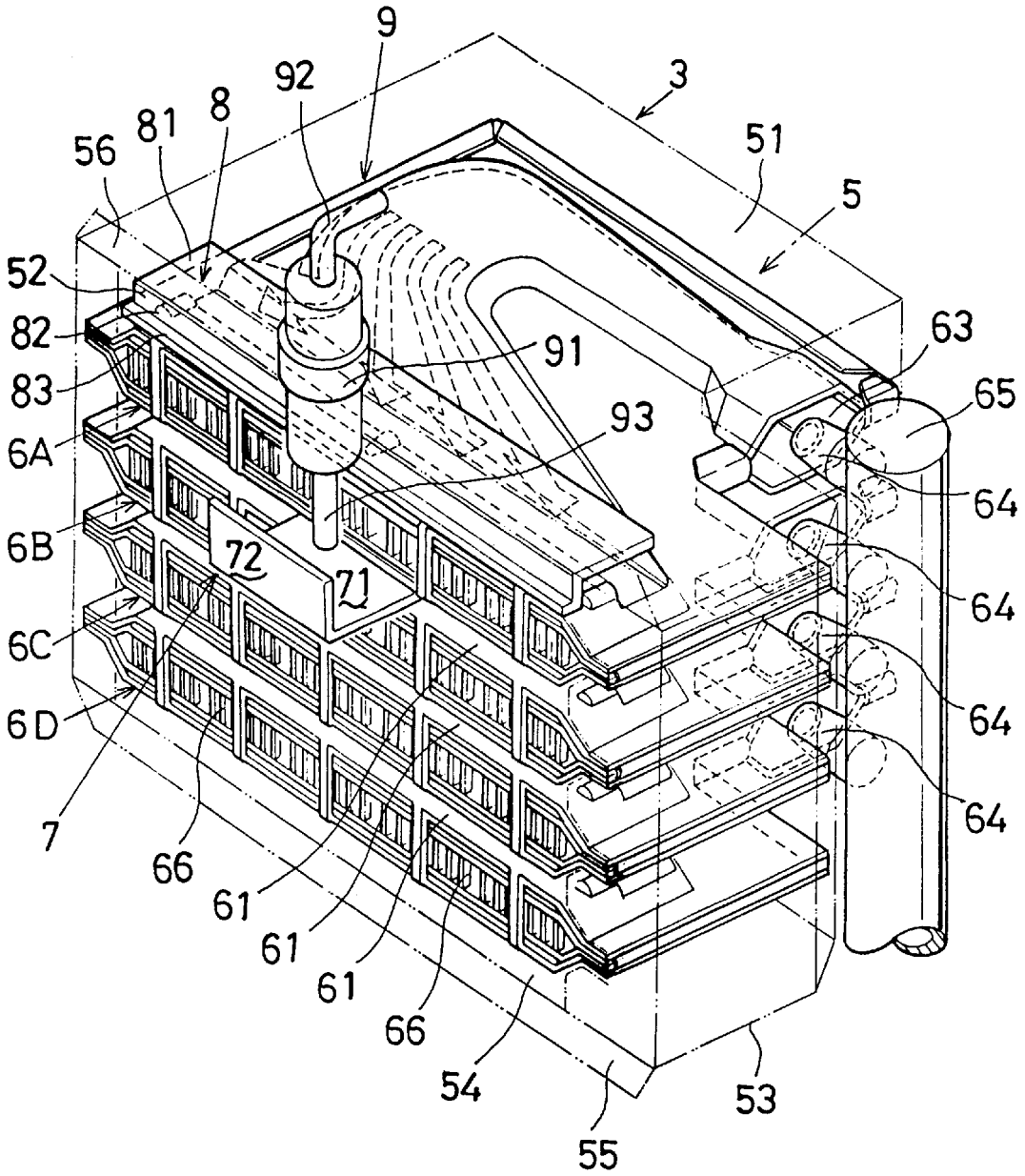
FIG. 4 is a perspective view of the burner.

Referring to FIGS. 1 and 2 which show a gas burner apparatus 100 according to a first embodiment of the invention. The gas burner apparatus 100 has a flat-shaped metal casing 1 in which a centrifugal type blower 2 is installed as shown at the right hand side in FIG. 1. At a lower section of the metal casing 1, a combustion cylinder 11 is laterally placed. At the right hand side in the combustion cylinder 11, a burner 3 is provided to which combustion air and gaseous fuel are supplied respectively through an outlet of the blower 2 and a fuel supply mechanism 12 so as to carry out combustion by forcibly supplying an outer air.

As shown in FIG. 2, a back plate 1A of the metal casing 1 has a metal farame 200 to arrange an intake pipe (air duct) to communicate the blower 2 with the outside air. The metal casing further has an exhaust pipe (exhaust duct) to expel an combustion gas out of a room. It is to be noted that the blower may be placed in the exhaust duct to introduce the outside air into the air duct (so-called intake system).

The blower 2 has an intake cylinder whose inner space serves as an inlet 21. The inlet 21 pierces the back plate 1A to be in the metal frame 200 so as to be connected to an intake duct 22 which is connected to an outer air intake duct 23 which passes through an opening H provided on a partition wall W.

Above the combustion cylinder 11, there lies a cylindrical heat exchanger 13 laterally within the metal casing 1. A left open end of the heat exchanger 13 is connected to that of the combustion cylinder 11 by means of an intermediary cylinder 14 which is rectangular in cross section. Between the heat exchanger 13 and the combustion cylinder 11, an exhaust cylinder 4 is provided in parallel therewith.

A right open end of the heat exchanger 13 is connected to that of the exhaust cylinder 4 by means of an intermediary cylinder 15 which is rectangular in cross section. As shown at the left hand side in FIG. 1, a leading end 41 of the exhaust cylinder 4 is angularly bent, and pierces the back plate 1A to form an exhaust opening 40. To the exhaust opening 40, an exhaust duct 44 is connected which has a lateral arm 43 and a vertical arm 42.

Concentrically passing through the outer air intake duct 23, within the opening H, is the lateral arm 43 of the exhaust duct 44 whose outer end extends beyond that of the air intake duct 23. At an upper space within the metal casing 1, a centrifugal fan 45 is laterally provided to supply a warm air current. When the fan 45 is activated, it draws an indoor air from an inlet opening 46 provided on an upper portion of the back plate 1A, and send the indoor air forth through an outlet opening 47 provided on a lower portion of the back plate 1A.

During the process in which the indoor air is drawn and sent forth, the indoor air is warmed by flowing through the heat exchanger 13, past the exhuast cylinder 4 and the combustion cylinder 11. On a bottom plate 1C of the metal casing 1, an evaporation dish 17 is retractably placed to adjust humidity. Numeral 18 designates a circulation pipe which sends a part of the combustion gas to the blower 2 to operate the burner at relatively low temperature so as to reduce the emission of NOx-related gas.

The burner 3, which is placed at the right hand side in the combustion cylinder 11, has flat-shaped burner units 6 (6A, 6B, 6C, 6D) which are parallel stacked with a certain space 61 interposed therebetween. The space 61 acts as a secondary air passage. The burner units 6A, 6B, 6C, 6D are interfit into a rectangular support frame 5. Between a side wall of the upper burner unit 6A and an upper wall 51 of the support frame 5, there is provided a space 52. Between a lower side wall of the lower burner unit 6D and an lower wall 53 of the support frame 5, there is provided a space 54. These spaces also serve as a secondary air passage.

At the left end side of the support frame 5, strip plates 55, 56 extend respectively from the upper wall 51 and lower wall 53 to be attached in turn to support plates 57, 58 which are each provided at the right hand side of the combustion cylinder 11 in order to support the burner 3 within the combustion cylinder 11. With each of the burner units 6, an open-ended duct 63 is provided at the upstream of the secondary air passage to introduce gaseous fuel and primary air current. At an elevational side of the burner units 6, a fuel gas supply tube 65 is provided which has four nozzles 64, 64, 64, 64, each facing the open-ended duct 63.

At a downstream side of the burner units 6, a multitude of flame slits (flame holes) 66 are provided in four rows with a predetermined clearance interposed therebetween. A secondary air shield plate 7 is provided at a bottom of the upper burner unit 6A to regulate the secondary air current supplied to the central flame slits 66 of the upper burner unit 6A. Within the upper wall 51 of the support frame 5, a secondary air passage shield plate 8 is provided to partially clog the space 52.

The secondary air shield plate 7 is generally formed into L-shaped configuration. The shield plate 7 has a lateral arm 71 directed along flames F built up on the flame slits 66, and having a vertical arm 72 bent in a direction to intersect the flames F. The secondary air passage shield plate 8 has a strip plate 81 welded to the upper wall 51 of the support frame 5, an occulusive plate 82 to clog the space 52, and an engagement plate 83 which is brought in contact with an upper side wall of the upper burner unit 6A. The secondary air passage shield plate 8 occulates an entire breadth of the space 52. Instead of occulating the entire breadth of the space 52, the secondary air passage shield plate 8 may be adapted to be the same breadth of the secondary air shield plate 7, and located vertically in correspondence to the secondary air shield plate 7.

At the right side of the combustion cylinder 11, a flame rod 9 is pierced therethrough as a temperature sensor to detect the burning condition of the burner 3. The flame rod 9 has an electrode 92 pierced through an insulator 91. A front end 93 of the electrode 92 faces the lateral arm 71 of the secondary air shield plate 7 so as to be in contact with the flames F. An output generated from the flame rod 9 is fed to a safety valve to close the safety valve provided in the gaseous fuel supply mechanism 12 when the burning condition deteriorates to lift the flames F.

According to the present invention, the burning condition of the flames F occulated by the shield plates 7, 8 deteriorates earlier than that of the other flame slits 66 since the supply of the secondary air current is restricted. For this reason, it is possible to detect abnormal burning with a slight reduction of air ratio ($\lambda$) in the entire burner 3 when air ratio in the burner unit 6A reduces due to a lenthwise alteration of the exhaust pipe 4 or the outer air intake duct 23. This holds true when the blower 2 loses sufficient capacity, or when either the exhaust pipe 4 and the outer air intake duct 23 is clogged by foreign matter.

In the burner apparatus according to the present invention, the inventors have striven to conform to the requirement that "a furnace shall not produce a concentration of carbon monoxide in excess of 0.04 percent in an air-free sample of the flue gases when tested in an atmosphere having normal oxygen supply." In order to meet the requirement, the inventors have introduced a CO Air-Free concept which is referred to as "COAF" hereinafter.

Figure 5A:
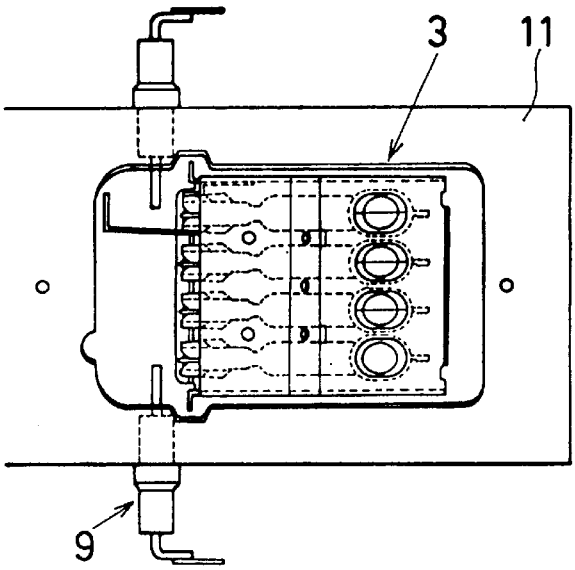
FIG. 5*a* is a schematic view of the burner.
Figure 5B:
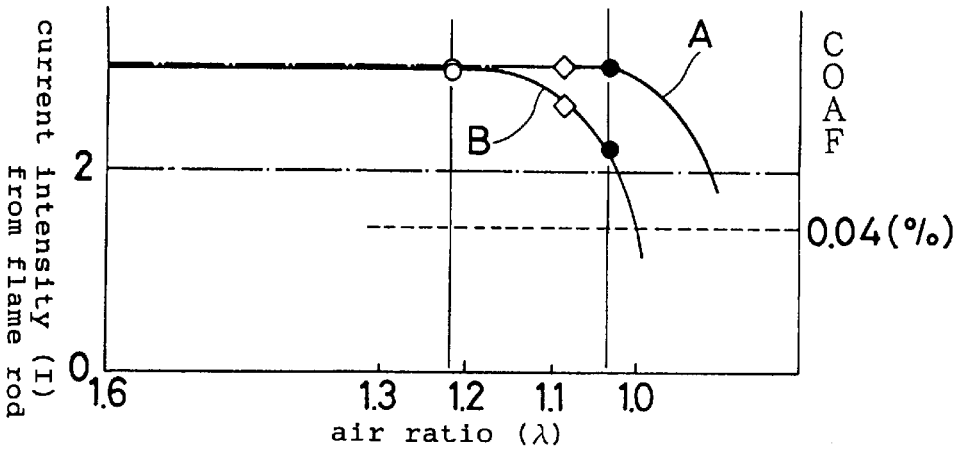
FIGS. 5*b* and 5*c* are graphical representations to depict characteristic curves of output from a flame rod.

FIG. 5*a* shows a flame rod 9*a* provided on the burner 3 in vertical relationship with the flame rod 9 to carry out a comparative experimental test by changing the air ratio (λ) of the burner 3 as a whole. FIG. 5*b* shows an experimental test result from which it is found that the output (B) of the flame rod 9 is more sensitive against the reduction of the air ratio (λ) than the output (A) of the flame rod 9*a*.

The structure is such that a current intensity (I) of the flame rod 9 drops to activate the safety valve early before the emission of carbon monoxide increases when an amount of the air supply reduces due to the use of a lengthened exhaust pipe 4, or when the exhaust pipe 4 is clogged by a piece of snow, a bird's nest or a spider's cobweb. This is also true when the blower 2 loses sufficient capacity, or when an intake air is short of oxygen because the combustion gas is getting back to the inlet opening.

Figure 5C:
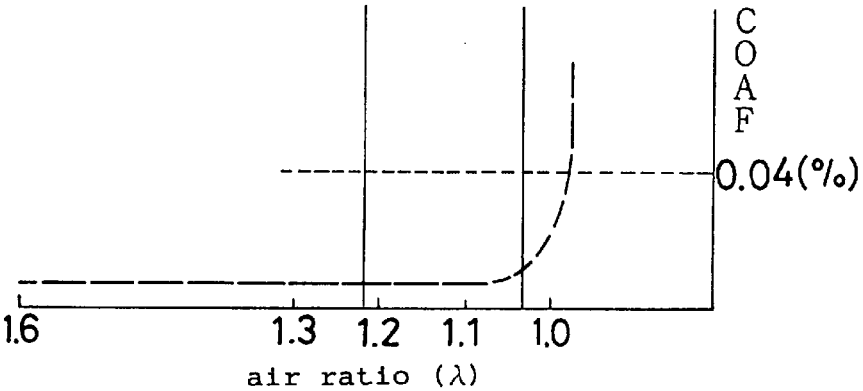

FIG. 5*c* shows how COAF (CO Air Free Value) changes depending on the air ratio (λ). The output (A) from the flame rod 9*a* drops rapidly when the air ratio (λ) is under 1.0 as shown in FIG. 5*b*. This is the case that is likely to increase COAF so as to result in an increased emission of carbon monoxide. On the contrary, the output (B) from the flame rod 9 drops rapidly when the air ratio (λ) is around 1.1, which makes it possible to activate the safety valve before the entire burning condition would have deteriorated.

It is to be noted that COAF in FIG. 5*c* increases as approching upward along the axis of ordinates while COAF in FIG. 5*b* decreases as approaching upward along the axis of ordinates.

It is also to be noted a specified one of the burner units 6 may be occulated to block an entry of the primary air current as an air reduction means to restrict the air supply toward the specifed flame slits more than that of the other ones of the flame slits 66.

It is further to be observed that the spaces may be partly occulated between the burner units 6 as a secondary air reduction member.

Alternatively, one of the secondary air shield plate 7 and the secondary air shield passage plate 8 may be omitted. These plates 7, 8 may be formed so a to surround the specified flame slits. As another alternative, these plates 7, 8 may be formed into porous a configuration.

Figure 6:
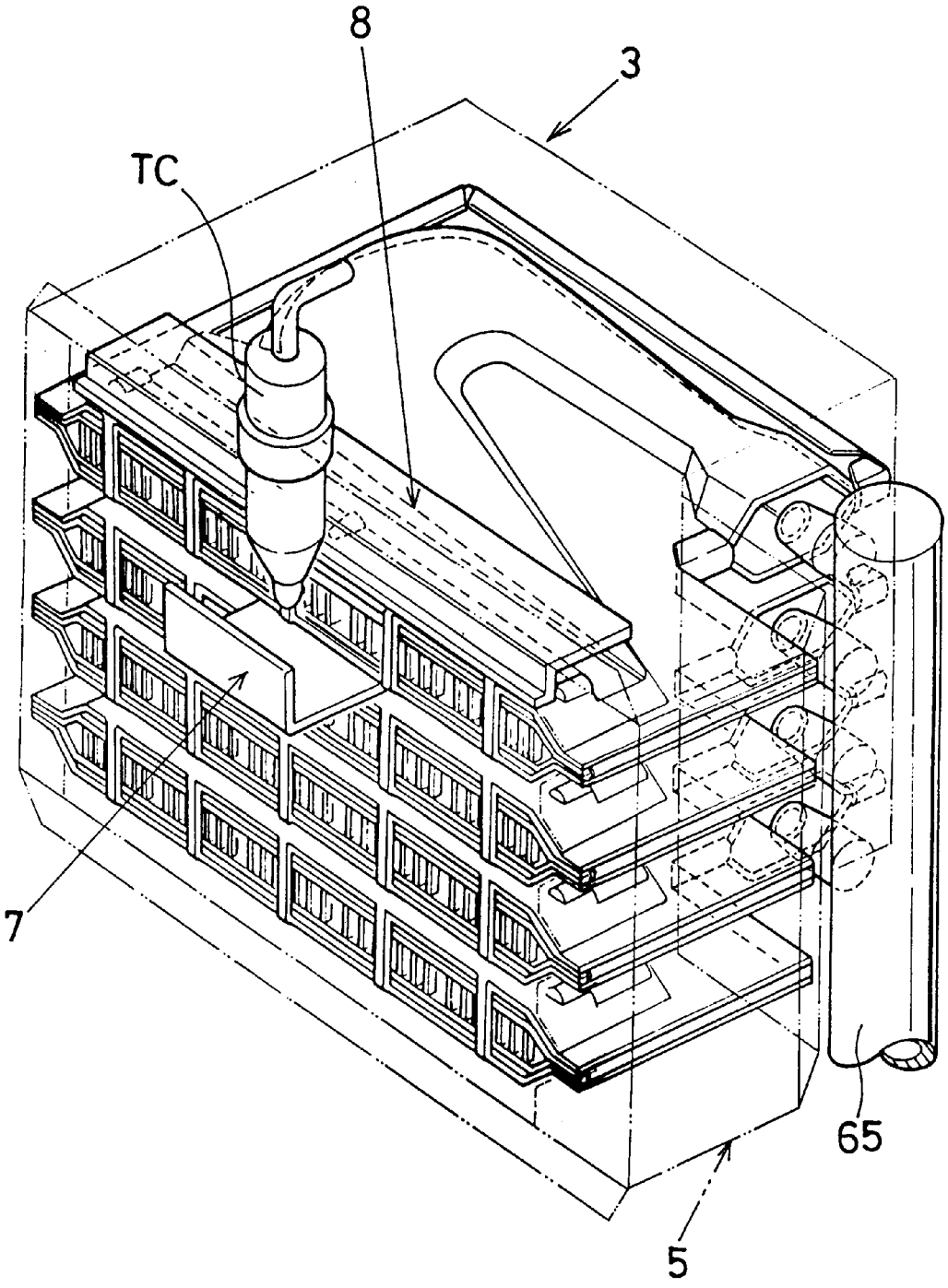
FIG. 6 is a perspective view of a gas burner which is to be incorporated into the gas heater apparatus according to a second embodiment of the invention.
Figure 7A:
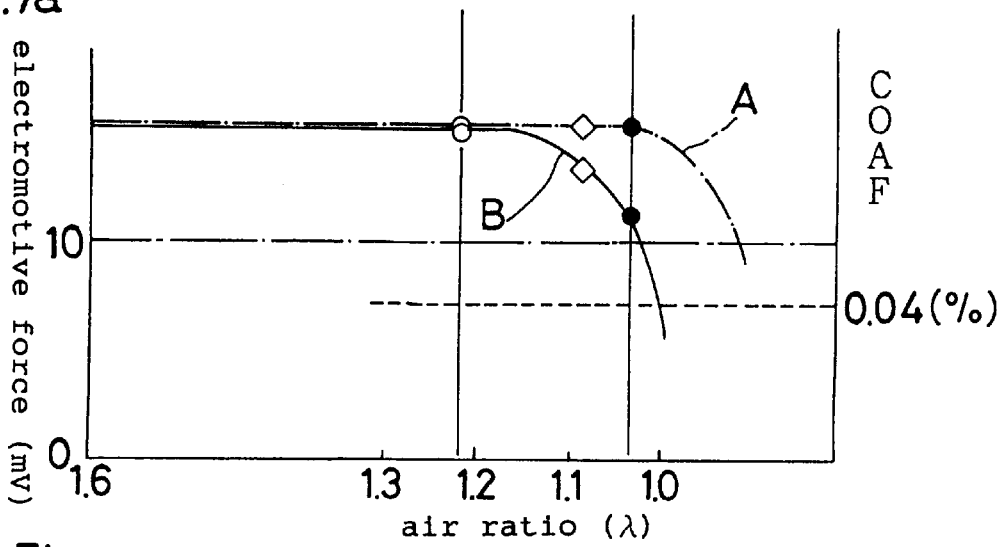
FIGS. 7*a* and 7*b* are graphical representations to depict characteristic curves of output from a thermocoupler according to the second embodiment of the invention.
Figure 7B:
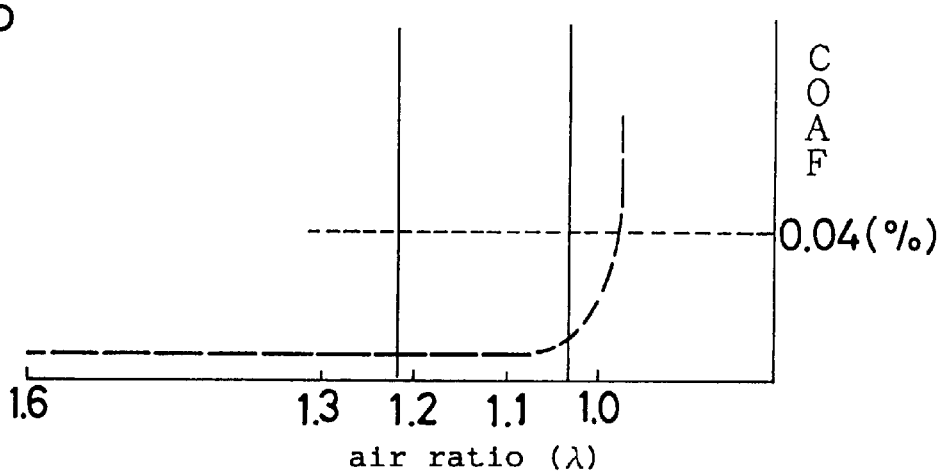

As shown in FIG. 6, according to a second embodiment of the invention a thermocoupler TC may be provided as the temperature provided as the temperature sensor instead of the flame rod 9 FIG. 7*a* shows a characteristic curve representative of an electromotive force generated from the thermocoupler TC. FIG. 7*b* shows how COAF varys depending on the air ratio (λ).

In this instance, as in the case of FIGS. 5*b*, 5*c*, COAF in FIG. 7*b* increases as approching upward along the axis of ordinates while COAF in FIG. 7*a* decreases as approaching upward along the axis of ordinates.

Figure 8:
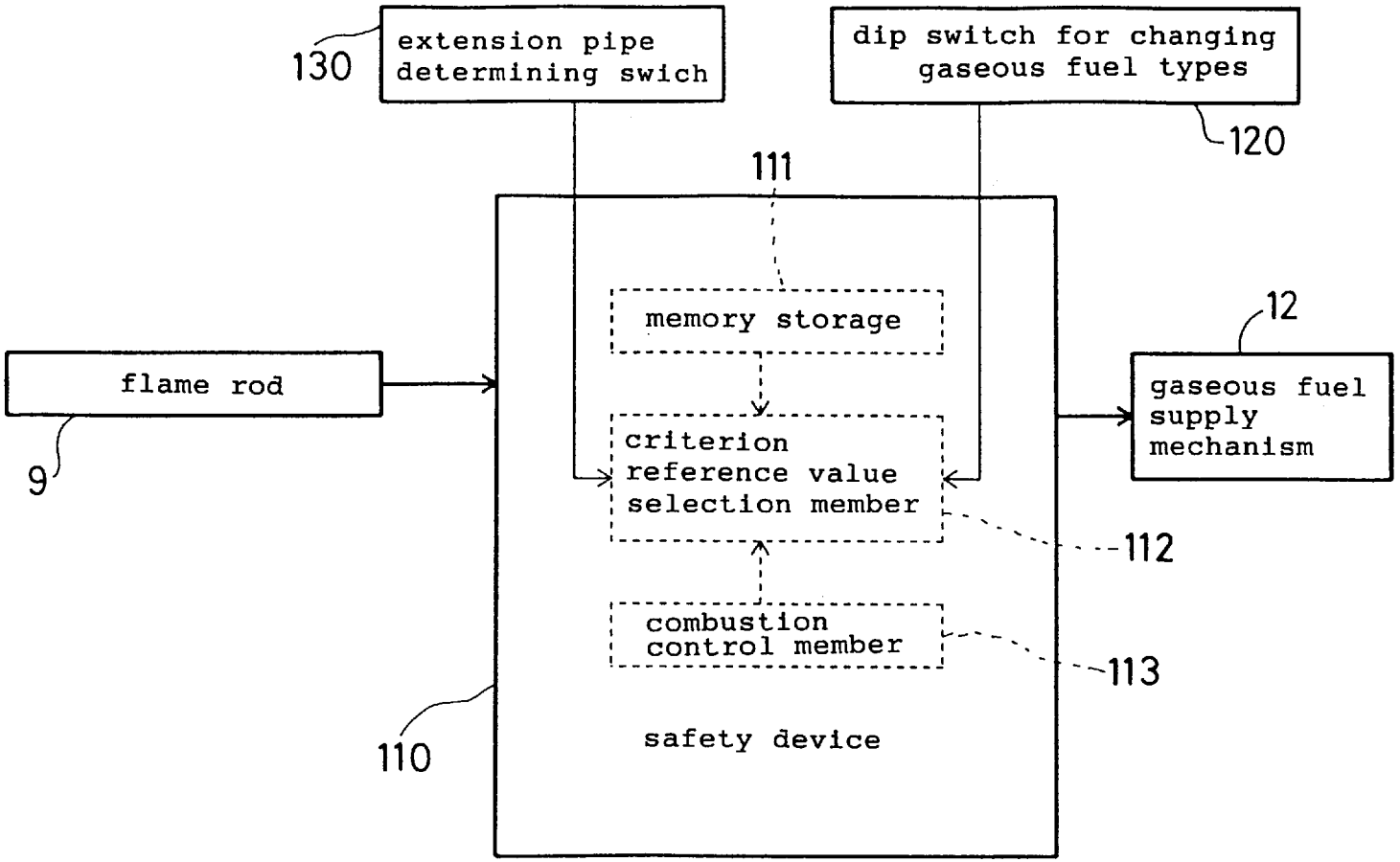
FIG. 8 is a block diagram of a safety device which is to be incorporated into the gas heater apparatus according to a third embodiment of the invention.
Figure 9:
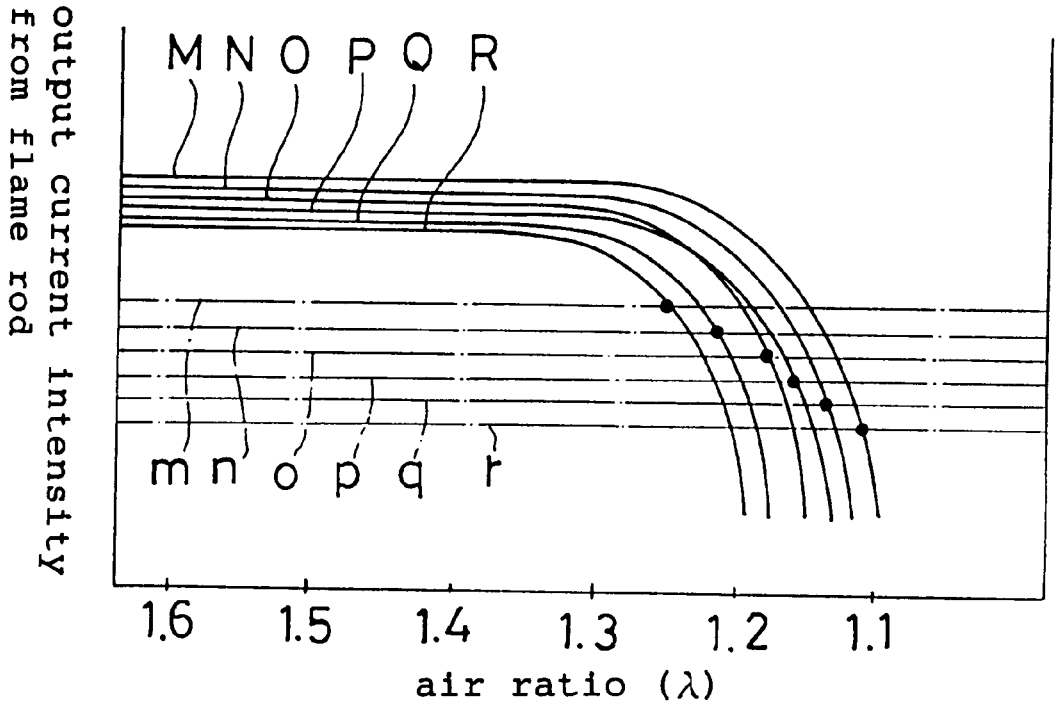
FIG. 9 is a graphical representation to schematically depict a relationship between a reference value of the safety device and the characteristic curve of the flame rod according to the third embodiment of the invention.

FIGS. 8 and 9 show a third embodiment of the invention in which a plurality of reference values are provided, as opposed to the first and second embodiment of the invention in which the abnormal combustion is detected on the basis of a single reference value such as the output from the flame rod 9 or the thermocoupler TC.

The plurality of reference values are represented by the gaseous fuel types to be used, an exhaust mode which changes depending on the air passage length of the intake duct 22 and exhaust duct 44, and the combustion quantity which the burner 3 produces depending on the temperature adjustment.

By way of illustration, these reference values are represented by Table 1.

TABLE 1

| | Natural Gas (NG) | | LP Gas (IPG) | |
|---|---|---|---|---|
| | Direct Exhaust Mode | Extension Mode | Direct Exhaust Mode | Extension Mode |
| Strong Combustion (7 shift stages) | A | D | G | J |
| Tep. Adjustment Area (2–6 shift stages) | B | E | H | K |
| Weak Combustion (a single shift stage) | C | F | I | L |

(*) Note:
A ~ L designate reference values to recognize an output current intensity generated from the flame rod.

The gaseous fuel types are represented by natural gas and liquefied petroleum gas. In correspondence to the gaseous fuel types, four types of resultant modes are predetermined in order to cope with an air passage of different lengths. One is a direct exhaust mode in which an extension pipe is not connected to the intake duct 22 and exhaust duct 44. The other is an extension mode in which the extension pipe is connected to the intake duct 22 and exhaust duct 44. In order to cope with the different combustion quantity which the burner 3 produces, the combustion quantity is divided into three sections, i.e., strong, weak and temperature adjustment area in correspondence to each of the modes to designate twelve reference values in total.

It is to be observed that these twelve reference values are not specified in tangible numbers since the reference values can be variously determined depending on the gaseous fuel types and the breadth from minimum to maximum combustion quantity.

Among the reference values thus predetermined, a group of the reference values are determined in correspondence to each of the gaseous fuel types depending on the combustion quantity. Another group of the reference values are determined in correspondence to each of the gaseous fuel types depending on the intake and exhaust air passage of different lengths. These groups of the reference values are stored by a storage memory 111 of a microcomputer in a safety device 110 as criterion reference value data. Upon operating the gas heater apparatus 100, one of the reference values is selected among the criterion reference value data to cope with the operating condition by means of a criterion reference value selection member 112 which is incorporated into the microcomputer.

The criterion reference value selection member 112 searches the modes at Table 1 based on a setting signal generated by a dip switch 120 for a manufacturer to predetermine the gaseous fuel type to be used, and at the same time, based on a changing signal generated by an extension pipe determining swich 130 to detect whether or not the extension pipe is connected to a connection end of the intake duct 22 and the exhaust duct 44. Then, the criterion reference value selection member 112 selects a single one reference value among the searched modes in correspondence to the combustion quantity on the basis of a control signal generated by a combustion control member 113 of the microcomputer which adjusts the combustion quantity of the burner 3.

In correspondence to each of the searched modes, the safety device 110 recognizes an output singnal (M~R in FIG. 9) from the flame rod 9 and compares it to the reference value (mar~r in FIG. 9) selected by the criterion reference value selection member 112. When the output singnal of the flame rod 9 becomes smaller than the reference value as shown at an intersection of phantom and solid lines in FIG. 9, the safety device 110 closes the valve to cease the combustion of the burner 3 so as to prevent the abnormal combustion from inadvertently continuing.

It is to be observed that the output signal of the flame rod 9 is represented by six types of modes in FIG. 9 for the purpose of convenience. The output signal of the flame rod 6 and the reference values at Table 1 are not specified in a tangible number.

As understood from the foregoing description, it is possible to determine whether or not the abnormal combustion occurs in the burner 3 based on the optimal reference value in correspondence to the combustion quantity depending on the gaseous fuel types and whether or not the extension pipe connection is used. This makes it possible to enlarge a good burning area of the gas burner apparatus of different fuel types and the exhaust modes so as to prevent the combustion from inadvertently ceasing while burner 3 maintains a good burning condition.

Figure 10:
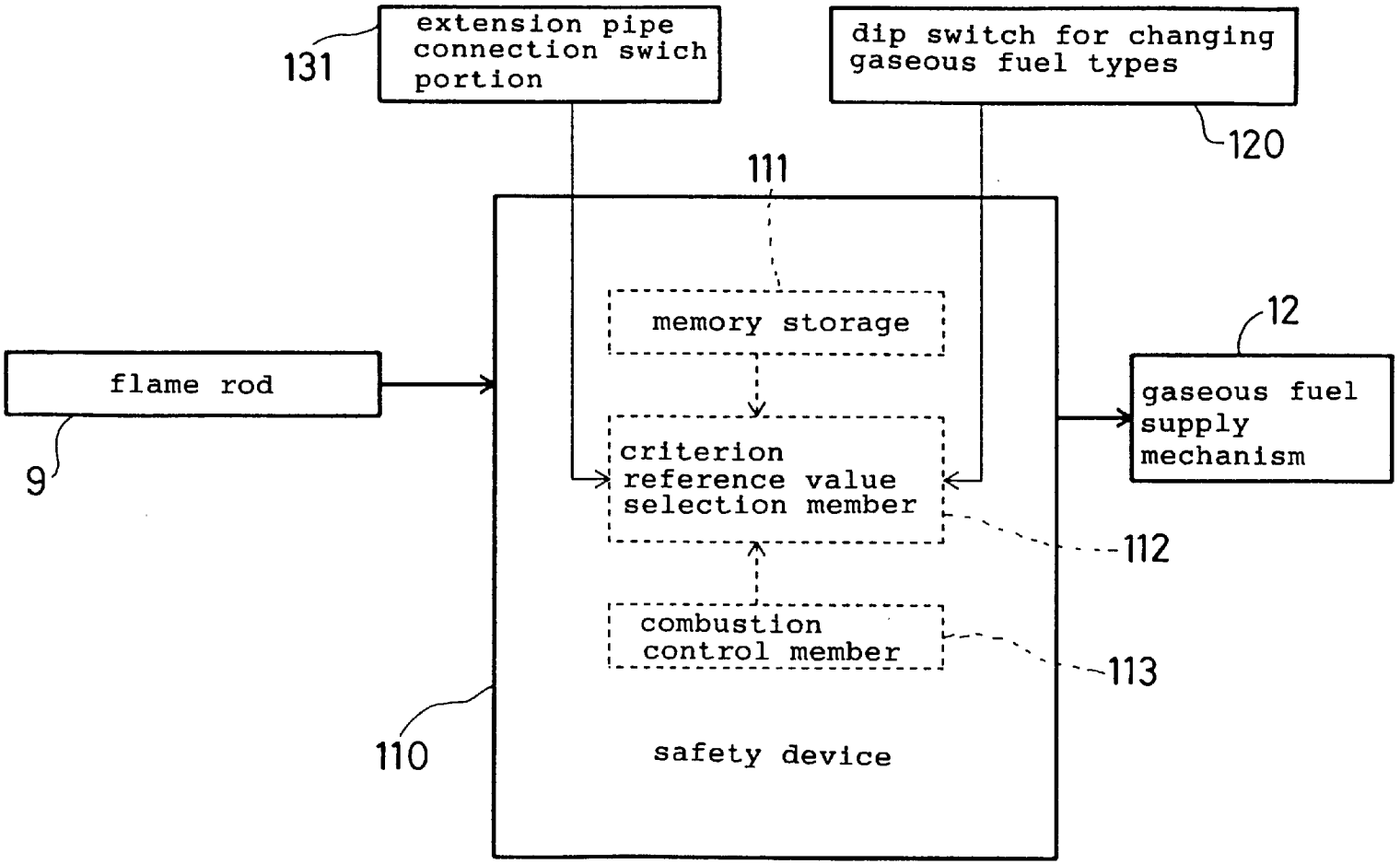
FIG. 10 is a block diagram of a safety device which is to be incorporated into the gas heater apparatus according to a fourth embodiment of the invention.

FIG. 10 shows a fourth embodiment of the invention in which an extension pipe connection switch portion 131 is provided instead of the extension pipe determining switch 130. The switch portion 131 on-off actuates a switch member on a control circuit base plate by an operator when the extension pipe is connected to the connection end of the intake duct 22 and the exhaust duct 44.

Examples of the switch portion 131 are as follows:

(1) Pin or pins of a pin terminal placed on the control circuit base plate.
(2) A circuit alteration by selectively severing lead wires which connect among switching portions by means of short circuit.
(3) An inexpensive dip switch, slide switch and various sorts of switching members.

As shown by the above examples, the switch portion 131 categorically belongs to those which are difficult to handle upon altering the circuit wiring once programming is set at the time of installing the gas heating apparatus.

It is to be appreciated that in addition to dividing the combustion quantity into three types of the strong, weak and temperature adjustment area which are distinguished by the scale of the flames F, the temperature adjustment area may be further divided minutely to increase accessible reference values to be selected if the storage memory 111 and the criterion reference value selection member 112 have more capacity while giving no significant influence on the programming procedures.

It is also to be noted that the present invention not only applies to a gas heater apparatus but may also be applied to a hot water server, water boiler and heater apparatus with a hot water server.

While the invention has been described with reference to the specific embodiments, it is understood that this description is not to be construed in a limitting sense in as much as various modifications and additions to the specific embodiments may be made by skilled artisans without departing the scope of the invention.

What is claimed is:

1. A cross flow type burner apparatus comprising a burner to which a gaseous fuel and air are supplied by means of a blower, said burner including a first set of flame holes and a second set of flame holes;

an air reduction member connected to said burner so as to reduce an amount of air supplied to said first set of flame holes of the burner so that the amount of air supplied to said first set of flame holes is less than the amount of air supplied to the second set of flame holes;

a temperature sensor adjacent said air reduction member and provided to detect a burning condition of flames built up on the first set of flame holes; and a safety member connected to said temperature sensor so as to be activated depending on an output generated from the temperature sensor, wherein the safety member includes a memory which stores a plurality of reference values for determining whether or not the safety member should activate in response to the output generated from the temperature sensor.

2. A cross flow type burner apparatus as recited in claim 1, wherein the air-reduction member is a secondary air reduction member which regulates an amount of secondary air supplied to the first set of flame holes of the burner.

3. A cross flow type burner apparatus as recited in claim 2, wherein the burner further includes a support frame and a plurality of flat burner units on which the first and second sets of flame holes are provided, and the flat burner units are interfit into the support frame to be longitudinally or latitudinal arranged with their neighboring spaces as secondary air passages.

4. A cross flow type burner apparatus as recited in claim 2 or 3, wherein the air reduction member is a secondary air shield plate provided on the downstream side of the flames built up on the first set of flame holes.

5. A cross flow type burner apparatus as recited in claim 2 or 3, wherein the air reduction member is a secondary air passage shield plate which clogs the space between the burner units or the space between the support frame and the burner units.

6. A cross flow type burner apparatus as recited in claim 1, wherein the temperature sensor is a flame rod or a thermocoupler.

7. A cross flow type burner apparatus as recited in claim 1, wherein the plurality of reference values correspond to a plurality of combustion quantity values which change depending on a burning condition of the burner, and the safety member further includes a selection member which selects one mode among the reference values versus the combustion quantity value for determining whether or not the safety member should activate.

8. A cross flow type burner apparatus as recited in claim 7, wherein a plurality of combinations among the reference values versus the combustion quantity value are stored in said memory, and the safety member further includes a selection member which selects one mode among the combinations of reference values versus the combustion quantity value depending on the burning condition of the burner.

9. A cross flow type burner apparatus as recited in claim 7, wherein a plurality of combinations among the reference values versus the air supply and exhaust length are stored in said memory, and the safety member further includes a selection member which selects one mode among the combinations of reference values versus the air supply and exhaust length depending on the burning condition of the burner.

10. A cross flow type burner apparatus as recited in claim 1, wherein the plurality of reference values correspond to a plurality of air supply and exhaust lengths of the burner and the safety member further includes a selection member which selects one mode among the reference values versus the air supply and exhaust length.

11. A cross flow type burner apparatus as recited in claim 10 or 9, wherein the selection member is a connection determining switch mounted on an air supply and exhaust passage connection of the burner to automatically set a desired combustion quantity depending on whether or not an air supply and exhaust passage extension member is connected to the air supply and exhaust passage connection.

12. A cross flow type burner apparatus as recited in claim 10 or 9, wherein the selection member is a connection switch mounted on an air supply and exhaust passage connection of the burner to manually set a desired combustion quantity depending on whether or not an air supply and exhaust passage extension member is connected to the air supply and exhaust passage connection.

13. A cross flow type burner apparatus as recited in claim 1, wherein the plurality of reference values correspond to a plurality of combustion fuel types which change depending on a burning condition of the burner, and the safety member further includes a selection member which selects one mode among the reference valves versus the combustion fuel type for determining whether or not the safety member should activate.

14. A cross flow type burner apparatus as recited in claim 13 or 8, wherein the selection member is a manual switch to set a desired mode depending on the combustion fuel type to be used.

15. A cross flow type burner apparatus comprising:

a burner to which a gaseous fuel and air are supplied by means of a blower, said burner including a first set of flame holes and a second set of flame holes;

an air reduction member connected to said burner so as to reduce an amount of air supplied to said first set of flame holes of the burner so that the amount of air supplied to said first set of flame holes is less than the amount of air supplied to the second set of flame holes, wherein said air reduction member is a secondary air shield plate, provided on the downstream side of the flames built up on the first set of flame holes, which regulates an amount of secondary air supplied to the first set of flame holes of the burner, said secondary air shield plate comprising a horizontal portion directed along the flames built up on the first set of flame holes, and a vertical portion directed to intersect the flames built up on the first set of flame holes;

a temperature sensor adjacent said air reduction member and provided to detect a burning condition of flames built up on the first set of flame holes; and a safety member connected to said temperature sensor so as to be activated depending on an output generated from the temperature sensor.

* * * * *